US007265529B2

(12) United States Patent
Nazarian

(10) Patent No.: US 7,265,529 B2
(45) Date of Patent: Sep. 4, 2007

(54) ZERO POWER START-UP CIRCUIT

(75) Inventor: Hagop A. Nazarian, San Jose, CA (US)

(73) Assignee: Micron Technologgy, Inc., Boise, ID (US)

( * ) Notice: Subject to any disclaimer, the term of this patent is extended or adjusted under 35 U.S.C. 154(b) by 127 days.

(21) Appl. No.: 10/921,465

(22) Filed: Aug. 19, 2004

(65) Prior Publication Data

US 2006/0038550 A1 Feb. 23, 2006

(51) Int. Cl.
*G05F 3/16* (2006.01)
*G05F 3/20* (2006.01)
*G05F 1/10* (2006.01)

(52) U.S. Cl. ..... 323/315; 323/901; 327/538

(58) Field of Classification Search ..... 323/315, 323/901, 314, 313; 327/538, 539, 543; 363/49
See application file for complete search history.

(56) References Cited

U.S. PATENT DOCUMENTS 4,333,047 A * 6/1982 Flink ..... 323/311
5,027,053 A 6/1991 Ohri et al.
5,384,739 A 1/1995 Keeth
5,481,179 A 1/1996 Keeth
5,508,604 A 4/1996 Keeth
5,552,739 A 9/1996 Keeth et al.
5,721,702 A 2/1998 Briner
5,969,549 A * 10/1999 Kim et al. ..... 327/143
6,002,242 A * 12/1999 Migliavacca ..... 323/312
6,002,245 A * 12/1999 Sauer ..... 323/315
6,107,866 A * 8/2000 Migliavacca ..... 327/539
6,150,871 A * 11/2000 Yee ..... 327/538
6,344,770 B1 * 2/2002 Zha et al. ..... 327/539
6,356,064 B1 * 3/2002 Tonda ..... 323/313
6,404,252 B1 * 6/2002 Wilsch ..... 327/198
6,456,557 B1 * 9/2002 Dadashev et al. ..... 365/226
6,496,057 B2 * 12/2002 Wada et al. ..... 327/543
6,496,421 B1 12/2002 Van De Graaff et al.
6,663,739 B2 12/2003 Walker et al.
6,677,808 B1 * 1/2004 Sean et al. ..... 327/539
6,684,288 B1 * 1/2004 Jacobs ..... 711/103
6,690,148 B2 2/2004 Harrison (Continued)

OTHER PUBLICATIONS

Wai-Kai Chen, Martin Brooke, The Circuits and Filters Handbook, 1995, CRC Press, 1st Edition, pp. 1605-1606.*

*Primary Examiner*—Bao Q. Vu
*Assistant Examiner*—Harry R Behm
(74) *Attorney, Agent, or Firm*—Leffert Jay & Polglaze, P.A.

(57) ABSTRACT

An improved start-up circuit and method for self-bias circuits is described that applies a start-up voltage and current to a self-bias circuit to initialize its operation in its desired stable state. Once the self-bias circuit converges to its desired state of operation a start-up voltage reference/voltage clamping circuit shuts off current flow to the self-bias circuit and the start-up circuit enters a low power mode of operation to reduce its overall current and power draw. This allows for embodiments of the present invention to be utilized in portable and/or low power devices where low power consumption is of increased importance. In one embodiment of the present invention, a band-gap voltage reference circuit is initiated utilizing a start-up circuit.

17 Claims, 3 Drawing Sheets

U.S. PATENT DOCUMENTS 6,713,996 B2 3/2004 Di Iorio
6,754,111 B2 6/2004 Pekny
6,795,343 B2 9/2004 Marotta et al.
6,894,473 B1 * 5/2005 Le et al. ..... 323/314
6,927,622 B2 * 8/2005 Rashid et al. ..... 327/538
6,963,191 B1 * 11/2005 McCalmont ..... 323/315
2006/0125461 A1 * 6/2006 Nakata ..... 323/313
2006/0197584 A1 * 9/2006 Hsu ..... 327/539

* cited by examiner

ZERO POWER START-UP CIRCUIT

TECHNICAL FIELD OF THE INVENTION

The present invention relates generally to self-bias circuits with two or more stable operating modes and start-up circuits that initialize them.

BACKGROUND OF THE INVENTION

Integrated circuits often contain self-biasing circuits that have two or more stable states of operation or convergence points, wherein one state is the desired operational state. Such self-bias circuits typically utilize a feedback circuit in their operation and therefore require a start-up circuit to initiate the desired state of operation at the proper convergence point upon circuit power-up. These self-bias circuits include, but are not limited to band-gap voltage reference circuits, current references, A/D converters, D/A converters, and feedback circuits.

Most self-bias circuits, such as band-gap voltage reference circuits, have two stable states of operation. Typically one state is the desired operation state and the other is a zero-current state. To prevent the zero-current state from occurring, undesirably, a start-up circuit is typically added to the self-bias circuit, which applies an initiating voltage or injects a starting current or current pulse to the self-bias circuit to initiate operation of the self-bias circuit in the desired state.

ICs and memories are designed to operate over a set range of supply voltages and temperatures. In modern ICs and memories the supply voltages have become increasingly smaller, which in part decreases the power usage in these circuits. As stated above, a problem in many prior art self-bias circuits, such as band-gap voltage references, is that the circuit has at least two stable states of operation. In a band-gap voltage reference circuit these states are where current is flowing in the circuit and the circuit is providing a stable voltage reference and where no current is flowing in the circuit and no voltage reference is being output. Upon power-up of the circuit an unassisted self-bias circuit will assume one of these two states of operation.

However, many of these start-up circuits themselves consume current and dissipate power when not active and become less effective at initializing the self-bias circuit as the supply voltage gets lower. The situation is even more problematic in portable devices as the total power used becomes more of an issue and it becomes important that the start-up circuit must draw as little current as possible during standby or normal operation. Additionally, the steady-state power draw of the start-up circuit after the self-bias circuit has been initialized and start-up circuit is inactive becomes an important factor.

For the reasons stated above, and for other reasons stated below which will become apparent to those skilled in the art upon reading and understanding the present specification, there is a need in the art for an improved start-up circuit for self-bias circuits and band-gap references circuits in modern ICs and memory circuits.

SUMMARY

The above-mentioned problems with start-up circuits for self-bias and band-gap reference circuits and other problems are addressed by the present invention and will be understood by reading and studying the following specification.

Embodiments of the present invention relate to start-up circuits for self-bias circuits that have two or more stable modes of operation. Start-up circuit embodiments of the present invention apply a start-up voltage and current to a self-bias circuit to initialize its operation in its desired stable state. Once the self-bias circuit converges to its desired state of operation, a start-up voltage reference/voltage clamping circuit shuts off current flow to the self-bias circuit and the start-up circuit enters a low power mode of operation to reduce its overall current and power draw. This allows for embodiments of the present invention to be utilized in portable and/or low power devices where low power consumption is of increased importance. In one embodiment of the present invention, a band-gap voltage reference circuit is initiated utilizing a start-up circuit.

For one embodiment, the invention provides a start-up circuit comprising a current mirror, a start-up voltage reference coupled to a first output of the current mirror, and an output transistor coupled between a second output of the current mirror and an output of the start-up circuit, wherein the output transistor is controlled by the voltage difference between a voltage of the start-up voltage reference and a voltage of the output of the start-up circuit.

In another embodiment, the invention provides a self-bias circuit comprising a feedback controlled circuit having two or more stable states of operation, wherein the feedback controlled circuit contains a central circuit where current can be injected to bootstrap the feedback controlled circuit into a desired state of operation, and a start-up circuit having an output, wherein the output is coupled to the central circuit. The start-up circuit including a current mirror, a start-up voltage reference coupled to a first output of the current mirror, and an output transistor coupled between a second output of the current mirror and the output of the start-up circuit, wherein the output transistor is controlled by the voltage difference between a voltage of the start-up voltage reference and a voltage of the central circuit.

In yet another embodiment, the invention provides a system comprising a processor coupled to a memory device. The memory device including an array of memory cells, and a band-gap voltage reference circuit. The band-gap voltage reference circuit comprising a current mirror coupled to an upper power rail, a first current path having a first bipolar junction transistor with a collector coupled to the current mirror through a first resistor, and an emitter coupled to a lower power rail, wherein the collector is coupled to a base of the first bipolar transistor, a second current path having second bipolar junction transistor and a second resistor, wherein a collector of the second bipolar junction transistor is coupled to the current mirror, a base of the second bipolar junction transistor coupled to the base of the first bipolar transistor, and where the second resistor is coupled between an emitter of the second bipolar junction transistor and the lower power rail, and a start-up circuit having an output, wherein the output is coupled to the first current path. The start-up circuit including a start-up circuit current mirror, a start-up voltage reference coupled to a first output of the start-up circuit current mirror, and an output transistor coupled between a second output of the start-up circuit current mirror and the output of the start-up circuit, wherein the output transistor is controlled by the voltage difference between a voltage of the start-up voltage reference and a voltage of the first current path.

In a further embodiment, the invention provides a method of operating a start-up circuit comprising outputting a start-up current from an output for a self-bias circuit from a current mirror source of a start-up circuit upon power-up, halting output of the start-up current when an output of the start-up circuit is greater than a start-up voltage reference, and halting operation of the current mirror upon halting output of the start-up current.

In yet a further embodiment, the invention provides a method of starting a self-bias circuit comprising injecting a start-up current from a start-up current mirror upon power-up into a central circuit of a self-bias circuit with two or more stable states of operation, wherein the injected start-up current operates to bootstrap the self-bias circuit into a desired state of operation, halting injection of the start-up current when a voltage of the central circuit is greater than a start-up voltage reference, and halting operation of the start-up current mirror upon halting injection of the start-up current.

Further embodiments of the invention include methods and apparatus of varying scope.

DETAILED DESCRIPTION

Figure 1:
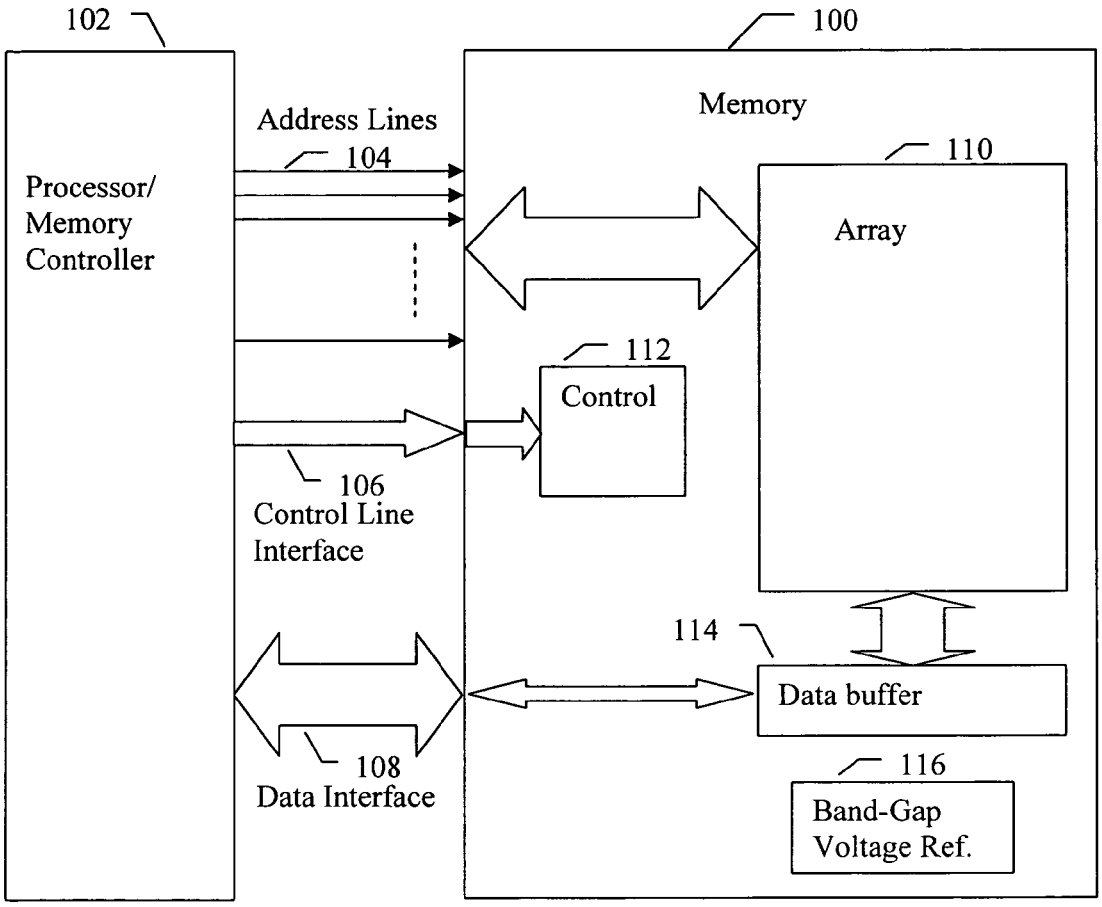
FIG. 1 is a simplified block diagram of a system containing a memory device in accordance with an embodiment of the present invention.

In the following detailed description of the preferred embodiments, reference is made to the accompanying drawings that form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention include start-up circuits for self-bias circuits that have two or more stable modes of operation. Start-up circuit embodiments of the present invention apply a start-up voltage and current to a self-bias circuit to initialize its operation in its desired stable state. Once the self-bias circuit converges to its desired state of operation a start-up voltage reference/voltage clamping circuit shuts off current flow to the self-bias circuit and the start-up circuit enters a low power mode of operation to reduce its overall current and power draw. This allows for embodiments of the present invention to be utilized in portable and/or low power devices where low power consumption is of increased importance. In one embodiment of the present invention, a band-gap voltage reference circuit is initiated utilizing a start-up circuit.

Integrated circuits and memories often contain self-bias circuits that utilize feedback in their operation and have two or more stable states of operation, wherein one state is the desired state of operation and one or more undesired states. The undesired states include, but are not limited to, a zero-current draw state and a high current draw state. These undesired operation states would produce an undesired reference voltage output. One such class of self-bias circuits are band-gap voltage reference circuits which provide a stable reference voltage for use with internal circuit operations. The band-gap voltage reference circuit is key in many integrated circuits (ICs) and memories where it is vital to have a stable reference voltage for use in many other circuits of the IC or memory. As stated above, to prevent the zero-current state from occurring, a start-up circuit is typically added to the self-bias circuit, which applies an initiating voltage or injects a starting current or current pulse to the self-bias circuit to initiate operation of the self-bias circuit in the desired state. In a band-gap voltage reference circuit these states are where current is flowing in the circuit and the circuit is providing a stable voltage reference and where no current is flowing in the circuit and no voltage reference is being output. Upon power-up of the band-gap voltage reference circuit bias circuit will assume one of these two states of operation and therefore most band-gap voltage circuits include a start-up circuit to ensure that it initiates correctly and is available to provide a voltage reference in the desired state.

As stated above, many of these start-up circuits themselves consume current and dissipate power when not active and become less effective at initializing the self-bias circuit as the supply voltage gets lower. In addition, the steady state power draw of the start-up circuit after the self-bias circuit has been initialized and start-up circuit is inactive becomes an important factor, particularly in low power and portable devices.

As an illustration, a problem in many prior art band-gap voltage references is that the band-gap reference circuit has two stable states of operation; one where current is flowing in the circuit and the circuit is providing a stable voltage reference and one where no current or a high current is flowing in the circuit and an undesired voltage reference is being output. Upon power-up of the circuit an unassisted band-gap reference will assume one of these two states of operation. Therefore to ensure that the band-gap circuit initiates operation correctly and is available to provide a desired voltage reference, most band-gap references include a start-up circuit. In portable devices, as total power used becomes more of an issue, the band-gap voltage reference circuit and the start-up circuit itself must draw as little steady state current as possible (typically in the range of 10 to 1 μA or less).

FIG. 1 is a simplified diagram of a system incorporating a memory device with a band-gap voltage reference embodiment of the present invention. FIG. 1 shows an illustration of a memory system, wherein a memory device 100, such as a Flash memory, incorporating a band-gap voltage reference of an embodiment of the present invention is coupled to an external processor or memory controller 102. It is noted that the memory system of FIG. 1 is only shown as an example, and other systems and embodiments of the present invention can include multiple types of other integrated circuits (i.e., a field programmable gate array (FPGA), a volatile memory device, an application specific integrated circuit (ASIC), etc.). Systems containing memory devices are well known in the art and the following description is intended only to be an overview of their operation and provide an example of their operation with an embodiment of the present invention.

In the system of FIG. 1, address values for the memory 100 are received from the processor 102 on the external address bus connections 104. The received address values are stored internal to the memory device and utilized to select the memory cells in the internal memory array 110. Internal to the memory device 100, data values from the bank segments (not shown) are readied for transfer from the memory device 100 by being sensed with the aid of the band-gap voltage reference circuit 116 and copied into internal latch circuits or data buffer 114. Data transfer from or to the memory device 100 begins on the following clock cycle received and transmitted on the bi-directional data interface 108 to the processor 102. Control of the memory device 100 for operations is actuated by the internal control circuitry 112. The control circuitry 112 operates in response external control signals received from the processor 102 on control signal external interface connections 106 and to internal events of the memory 100. It is noted that in alternative embodiments, the address bus connections 104 and the data interface 108 can be combined into a single address/data bus interface.

Memory devices that do not lose the data content of their memory cells when power is removed are generally referred to as non-volatile memories. An EEPROM (electrically erasable programmable read-only memory) is a special type non-volatile ROM that can be erased by exposing it to an electrical charge. EEPROM comprise a large number of memory cells having electrically isolated gates (floating gates). Data is stored in the memory cells in the form of charge on the floating gates. Yet another type of non-volatile memory is a Flash memory. A typical Flash memory comprises a memory array, which includes a large number of memory cells. Each of the memory cells includes a floating gate embedded in a MOS transistor. The cells are usually grouped into sections called "erase blocks." Each of the cells within an erase block can be electrically programmed selectively by tunneling charges to the floating gate. The negative charge is typically removed from the floating gate by a block erase operation, wherein all floating gate memory cells in the erase block are erased in a single operation.

Two common types of Flash memory array architectures are the "NAND" and "NOR" architectures, so called for the resemblance which the basic memory cell configuration of each architecture has to a basic NAND or NOR gate circuit, respectively. Other types of non-volatile memory include, but are not limited to, Polymer Memory, Ferroelectric Random Access Memory (FeRAM), Ovionics Unified Memory (OUM), Nitride Read Only Memory (NROM), and Magnetoresistive Random Access Memory (MRAM).

It is noted that in embodiments of the present invention, the transistors specified can be replaced by equivalent transistors of differing technology types, including, but not limited to positive field effect transistors (P-FET), negative field effect transistors (N-FET), positive metal oxide semiconductor (PMOS) transistors, negative metal oxide semiconductor (NMOS) transistors, BJT transistors, junction field effect transistors (JFET), and metal semiconductor field effect transistors (MESFET).

Typical band-gap voltage reference circuits utilize the forward biased junction voltage drop of a diode or the base-emitter diode junction of a BJT to set a reference voltage. In a forward biased junction of a diode or the base-emitter diode junction of a BJT, the forward current is $I_b=I_0e^{v_{be}/v_t}$, where $I_0$ is the diode saturation current and is proportional to the area of the diode junction or the base-emitter area of the BJT, and $v_{be}$ is the diode or base-emitter voltage. The term $v_t$ is defined as $v_t=kT/q$, where k is the Boltzmann constant, T is the absolute temperature, and q is the electron charge. It is noted that resultant $v_{be}$ from the above equation changes at approximately −2 mV/° C. at a constant forward bias current, $I_b$, and must be compensated for if used as a voltage reference.

Figure 2:
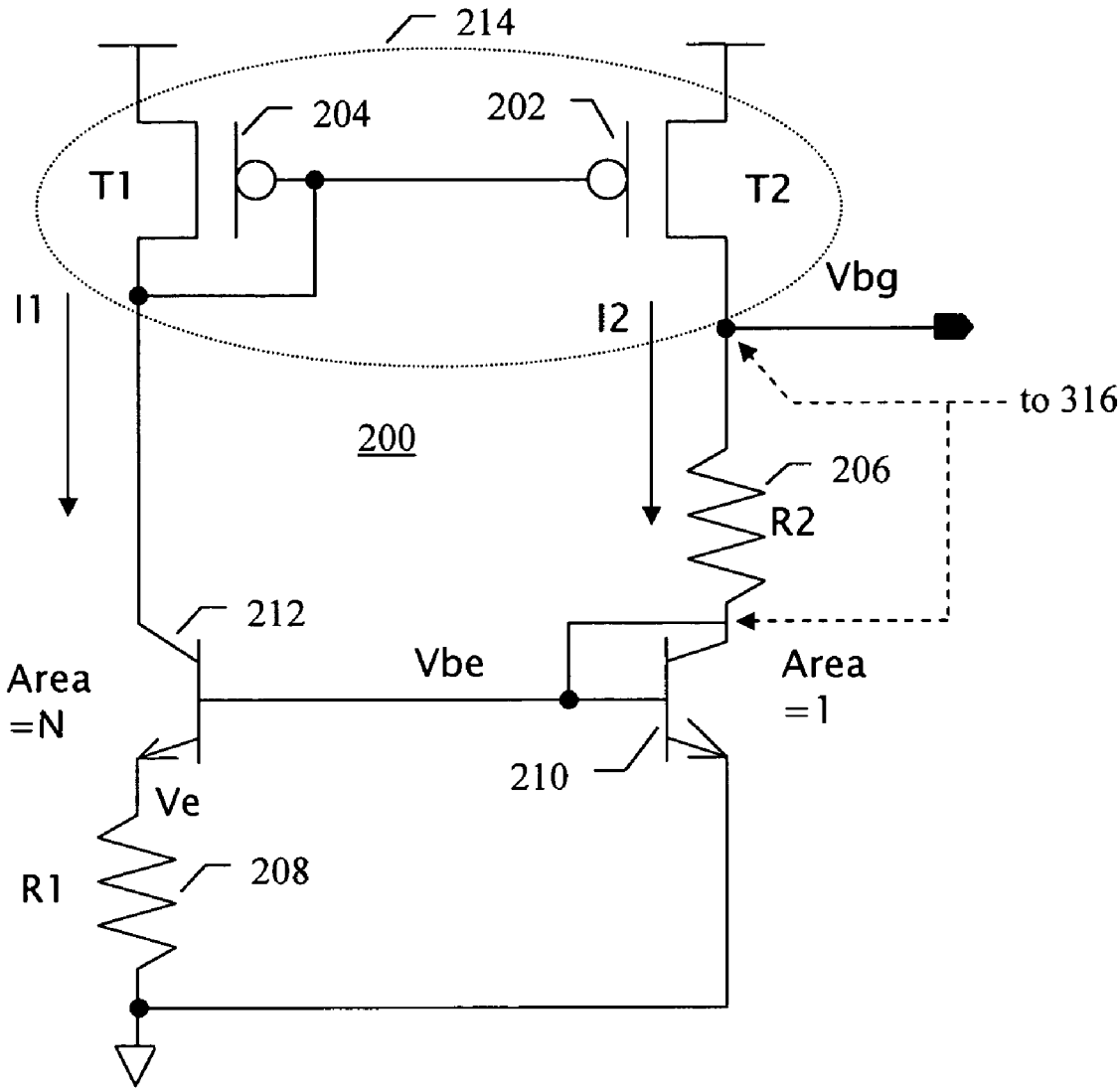
FIG. 2 is a simplified diagram of a band-gap voltage reference in accordance with an embodiment of the present invention.

FIG. 2 is a simplified diagram of a self-biasing band-gap reference circuit 200 that contains two positive field effect transistors (P-FET) 202, 204, resistors 206, 208, and two NPN BJTs 210, 212. P-FET transistors 202 and 204 are arranged in a current mirror circuit 214. In the current mirror circuit 214 the sources of the P-FET transistors 202, 204 are coupled to the upper power rail (Vcc), the gate of P-FET transistor 204 is coupled to its drain, and the gate of P-FET transistor 202 is coupled to the gate of P-FET transistor 204. The collector of the second NPN BJT 210 is coupled to the drain of P-FET transistor 202 of the current mirror 214 through resistor R2 206. The emitter of NPN transistor 210 is coupled to the lower power rail (ground). The collector of NPN transistor 210 is also coupled to its base, putting the NPN transistor 210 in what is called "diode coupled mode" giving the NPN transistor 210 the I-V characteristics of a PN junction diode. The first NPN BJT 212 has a base-emitter junction size that is N times larger than that of the second NPN BJT 210, or there are N multiple NPN BJT's 212 that are coupled in parallel, where N is >1; increasing N has the effect of modifying the current amplification, β or $h_{FE}$, of the BJT. The collector of the first NPN BJT 212 is coupled to the drain of P-FET transistor 204 of the current mirror 214, and the base is coupled to the lower power rail (ground) through resistor R1 208. The generated reference voltage $V_{bg}$ is taken from the node between resistor R2 206 and P-FET transistor 202 of the current mirror circuit 214. It is noted that in alternative embodiments, the generated reference voltage $V_{bg}$ is adjustable and can be taken from selected taps on resistor R2 206.

In the voltage generation mode of operation (the desired mode of operation), the current flowing through the diode connected NPN BJT 210 sets the voltage $V_{be}$ at the coupled base and collector. The voltage level $V_{be}$ in turn enables the first NPN BJT 212 and sets it into active mode. The voltage level at the collector of the active first NPN BJT 212 sets the current flow in P-FET transistor 204 of the current mirror circuit 214 by pulling down its coupled gate and drain. This in turn, sets the current flow in P-FET transistor 202 of the current mirror 214 and therefore the current flowing to the diode connected NPN BJT 210 in a feedback loop.

In the zero-current mode of operation, a low voltage $V_{be}$ (approximately ground or 0V) at the coupled base and collector of the diode connected NPN BJT 210 turns off the first NPN BJT 212, shutting off current flow through it and keeping the voltage at its collector high (approximately Vcc). A high voltage (greater than Vcc−Vtp, where Vtp is the threshold voltage of P-FET transistor 204) turns off P-FET transistors 204 and 202 of the current mirror 214. As P-FET transistor 202 is turned off due to the high voltage (greater than Vcc−Vtp) on its gate, substantially no current flows through resistor R2 206 to operate the diode connected NPN BJT 210, keeping it turned off and completing the feedback loop.

The current mirror circuit 214 of the band-gap voltage reference circuit in the voltage reference generation mode generates two substantially identical currents ($I=I_2$). In this, P-FET transistor 204 operates in saturation with its gate tied to its drain, yielding a constant current at $V_{gs}$. As the gate of P-FET transistor 202 is tied to the gate of P-FET transistor 204, and it is of the same size and characteristics, it flows the same current as P-FET transistor 204 with negligible differences. The constant current set by this feedback loop (second NPN BJT 210 to first NPN BJT 212 to P-FET transistor 204 to P-FET transistor 202) sets the voltage drop across resistor R2 206, which in combination with the voltage level $V_{be}$ gives the band-gap voltage reference circuit 200 output voltage $V_{bg}$ as sampled at the drain of P-FET transistor 202.

The current $I_2$ flows through resistor R2 206 to the diode-coupled second NPN BJT 210. As the collector of NPN BJT 210 is coupled to its base, it is at the same voltage level as the base (Vbe). The voltage Vbe can determined, as stated above, from the diode equation $I_{B1}=I_0e^{v_{be}/v_t}$, where $v_t$=kT/q. With the base of the first NPN BJT 212 coupled to the base of the diode coupled second NPN BJT 210 its base voltage is at the same level as that of the second NPN BJT 210. The base-emitter diode voltage drop of the first NPN BJT 212, however, is minus the voltage drop, $V_e$, across the resistor R1 208, and the base-emitter junction is N times larger than that of the second NPN BJT 210. Thus the diode equation of the first NPN BJT 212 is $I_{B2}=NI_0e^{(v_{be}-v_e)/v_t}$, where $v_t$=kT/q.

$I_1$ is only coupled to the collector of the first NPN BJT 212, thus $I_1=I_{C1}$. $I_2=I_{C2}+I_{B2}+I_{B1}$ because of the diode coupling of the second NPN BJT 210 and the coupled base of the first NPN BJT 212. The collector currents due to the basic current amplification operation of the NPN BJT transistors 210, 212 is $I_{C2}=\beta_2I_{B2}$, and $I_{C1}=\beta_1I_{B1}$, where β also called $h_{FE}$. As $I_1=I_2$, due to the operation of the current mirror circuit 214, the collector and base currents of the two NPN BJT transistors are related by the equation $$I_1=I_{C1}=I_{C2}+I_{B2}+I_{B1}=I_2.$$

If, in the best case, $\beta_1$ and $\beta_2$ are large ($\beta_1\beta_2$>>1), we can assume that $I_{B2}$ and $I_{B1}$ are small, and thus can be ignored giving $I_2=I_{C2}$ and therefore $I_2=I_1=I_{C2}=I_{C1}=\beta_2I_{B2}=\beta_1I_{B1}$. If $\beta_2=\beta_1$, which can be assumed for BJTs made on the same semiconductor chip with the same process, then $I_{B2}=I_{B1}$ and thus $I_{B2}=I_{B1}=I_0e^{v_{be}/v_t}=NI_0e^{(v_{-we})/v_t}$. This gives $v_e=v_t \ln N=(kT \ln N)/q$, where $v_e$ is the voltage at the emitter of the first NPN BJT 212, which is the same as $v_e=(I_1+I_{B1})R_1$, or $v_e=I_{R1}$ if $\beta_1$ is assumed large and thus $I_{B1}$ is small. Since $I_2=I_1$, because of the current mirror circuit 214, we can rewrite this as $v_e=I_2R_1$ which gives $I_2=v_e/R_1$, which in turn yields $I_2=(kT \ln N)/R_1q$ when $v_e$ is substituted for.

The reference voltage $V_{bg}$ is set by the voltage drop across resistor R2 206 and the voltage drop across the diode-connected second NPN BJT 210, $V_{be}$. Thus $V_{bg}=V_{be}+I_2R_2$. Substituting the above equation for $I_2$ yields $V_{bg}=V_{be}+R_2(kT \ln N)/R_1q$. As $V_{be}$ changes by approximately −2 mV/° C., $R_2$, N, and $R_1$ can be chosen to modify $R_2(kT \ln N)/R_1q$ to compensate at +2 mV/° C., temperature compensating the band-gap voltage reference circuit.

Figure 3:
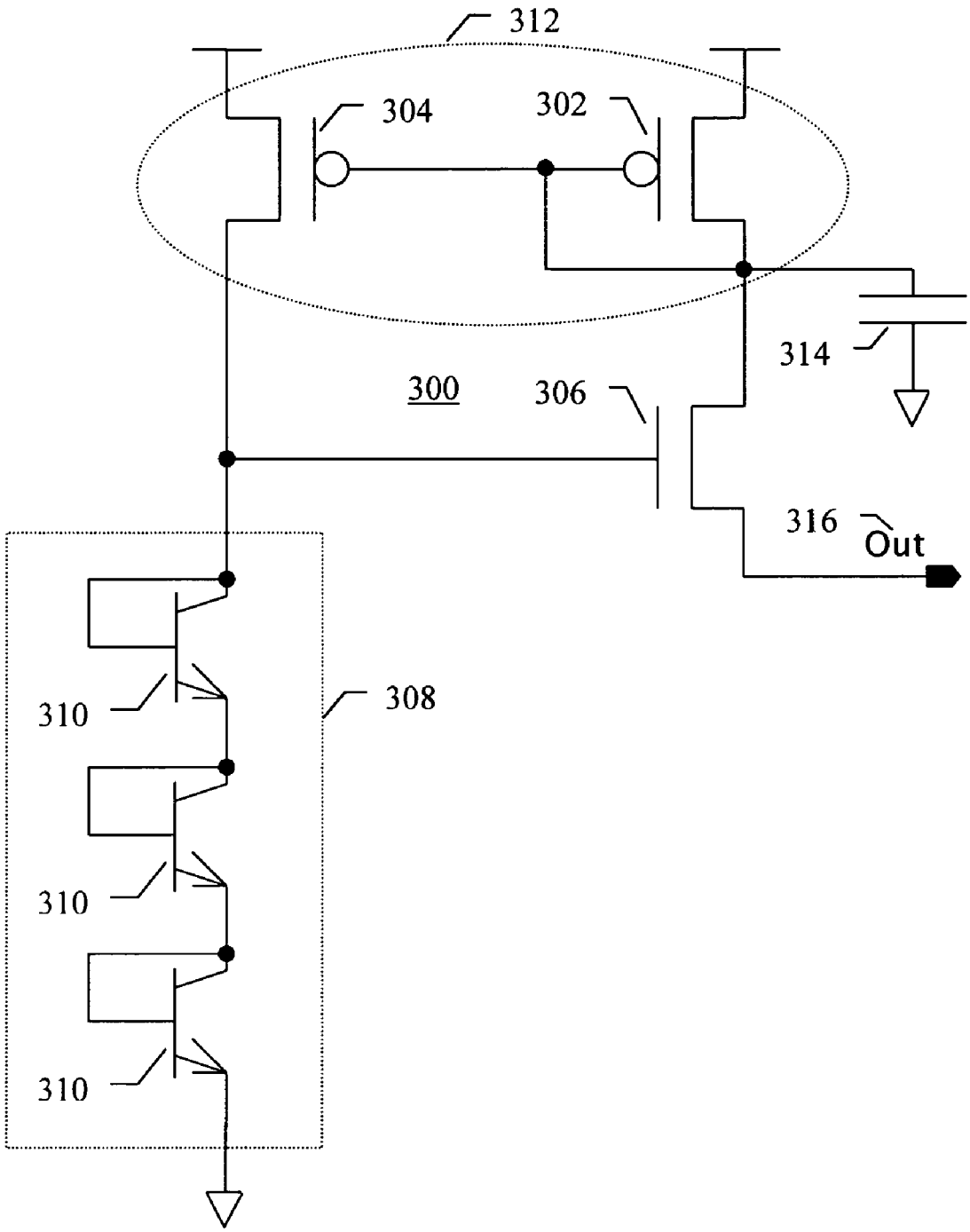
FIG. 3 is a simplified diagram of a self-bias start-up circuit in accordance with an embodiment of the present invention.

FIG. 3 is a diagram of a self-bias start-up circuit 300 of an embodiment of the present invention. The self-bias start-up circuit 300 upon power-up provides a starting current and voltage to a coupled self-bias circuit (not shown) to initiate its operation in the desired mode. The start-up circuit 300 is typically coupled to a central circuit of the self-bias circuit, where the injection of a current or a voltage by the start-up circuit 300 will bootstrap operation of the self-bias circuit's feedback loop and set the self-bias circuit to the desired convergence point. For example, in the band-gap voltage reference 200 of FIG. 2, coupling the start-up circuit 300 to the drain of P-FET transistor 202, resistor 206, or the base or collector of NPN BJT 210 and injecting the start-up current from the start-up circuit 300 into the path of current I2 to initialize operation in the desired voltage reference mode. Upon the central circuit of the self-bias circuit nearing its desired operation point, the rising voltage of the central circuit at the output of the start-up circuit 300 shuts off the start-up circuit 300 and places it in a steady state low power mode, minimizing its current drain and power dissipation.

In FIG. 3, the self-bias start-up circuit 300 contains two P-FET transistors 302, 304 coupled in a current mirror circuit 312. In the current mirror circuit 312 the gates of the P-FET transistors 302, 304 coupled to the drain of the P-FET transistor 302 and the sources are coupled to the positive power rail (Vcc). A start-up voltage reference/voltage clamp circuit 308 is coupled between the drain of P-FET transistor 304 and the negative power rail (ground). The voltage clamp circuit 308 contains three series-coupled diode connected NPN BJTs 310, where the base of each NPN BJT 310 is connected to its collector so that it operates in a diode mode. A drain of a negative field effect transistor (N-FET) 306 is coupled to the drain of P-FET transistor 302. The gate of N-FET transistor 306 is also coupled to the drain of P-FET transistor 304 and the voltage clamp circuit 308. The source of the N-FET transistor 306 forms the output 316 of the start-up circuit 300 and is coupled to inject current into the associated self-bias circuit.

During power-up, a low voltage from the power-down state is expressed on the gates of P-FET transistors 302 and 304 of the current mirror circuit 312, turning them on and causing current to be passed from the positive power rail (Vcc) through P-FET transistors 302 and 304. An additional capacitor 314 is recommend to be coupled to the gates of the P-FET transistors 302, 304 and ground to capacitively couple the voltage on the gates to ground during power-up and ensure proper operation of the current mirror circuit 312. The current flowing from the positive power rail (Vcc) through P-FET transistor 304 is passed through the voltage clamp circuit 308 and sets a gate voltage at the selected clamping voltage on the gate of N-FET transistor 306. The voltage clamping circuit 308 contains a series of three diode-coupled NPN BJT transistors 310, setting a clamping voltage of approximately three base-emitter diode drops (3*Vbe). The clamping voltage applied to the gate of N-FET transistor 306, turns it on and injects a start-up current from the source of the N-FET transistor into the selected central circuit of the associated self-bias circuit. The current flowing through the N-FET transistor pulls down the coupled drain of P-FET transistor 302 and the coupled gates of P-FET transistors 302 and 304, maintaining the P-FET transistors 302, 304 of the current mirror 312 in an on, and current flowing, condition.

Upon nearing the desired operating state of the associated self-bias circuit, the self-bias circuit becomes self-supporting in its feedback state and will enter the desired state on its own. As this happens, the voltage on the node of the central circuit of the self-bias circuit rises to be at or above the voltage applied by the voltage clamping circuit 308 on the gate of N-FET transistor 306. This rising voltage on the output 316 of the start-up circuit 300 turns off N-FET transistor 306 and stops current injection by the start-up circuit 300 into the self-bias circuit. When N-FET transistor 306 is turned off by the rising voltage on the output 316 of the start-up circuit 300, the current flow from P-FET transistor 302 is stopped and the voltage on the drain and the coupled gates of P-FET transistors 302 and 304 rises until the P-FET transistors 302 and 304 start to enter pinch-off when the drains near a threshold voltage drop below the positive power rail (Vcc-Vtp). This high voltage of Vcc−Vtp applied to the gate of P-FET transistor 304 of the current mirror 312 puts it in a near pinch-off mode and shuts off nearly all current flow through it and the coupled voltage clamp circuit 308 except for a small leakage current. This places the start-up circuit 300 in a low-current-draw steady-state mode which is maintained while the associated self-bias circuit is operating at its desired convergence point and a voltage greater than the voltage set by the voltage clamping circuit 308 minus a Vt is applied to the start-up circuit 300 output 316 (in the case of FIG. 3 this is $3*V_{be}$-Vtn).

It is noted that the P-FET transistors 302 and 304 can be of differing sizes or process types in alternative embodiments of the present invention, allowing their threshold voltages and current flow in the current mirror to be different. This allows, in one embodiment of the present invention where the threshold voltage (Vtp) for P-FET transistor 304 to be higher than the threshold voltage (Vtp) of P-FET transistor 302, for a further reduction in the shutoff steady state current draw of the start-up circuit 300. In this mode of operation, P-FET transistor 304 will be placed closer to pinch-off mode due to its higher threshold voltage Vtp than its gate coupled companion in the current mirror, P-FET transistor 302, and thus it will flow less current when the associated self-bias circuit is operating in the non-zero current state and start-up circuit 300 is in shutoff steady state.

In another embodiment of the present invention a capacitor is coupled between the gate of the P-FET transistors 302, 304 and the negative power rail to ensure that the gates are pulled low during power-up. It is noted that the native capacitance of the N-FET transistor 306 also acts in the same capacity to pull the gates of P-FET transistors 302, 304 low at power-up and that N-FET transistor 306 may be altered in size to increase capacitance to also accomplish a more ensured start during power-up.

It is also noted that the start-up voltage reference/voltage clamping circuit 308 can be adjusted to select the shutoff voltage of the start-up circuit 300. It is further noted that other start-up voltage reference/voltage clamping circuits 308 are possible, including, but not limited to one or more PN junction diodes, one or more Schottky diodes, one or more zener diodes, one or more diode-connected field effect transistors (FETs) or metal oxide semiconductor (MOS) transistors, one or more resistors or a resistor voltage divider, or any combination of these devices. It is additionally noted that in other embodiments of the present invention, the P-FET transistors 302, 304 and N-FET transistor 306 can be replaced by equivalent transistors of differing technology types, including, but not limited to positive metal oxide semiconductor (PMOS) transistors, negative metal oxide semiconductor (NMOS) transistors, BJT transistors, junction field effect transistors (JFET), and metal semiconductor field effect transistors (MESFET).

It is also noted that other embodiments of the present invention incorporating the disclosed start-up circuits and methods are possible and should be apparent to those skilled in the art with the benefit of this disclosure.

CONCLUSION

An improved start-up circuit and method for self-bias circuits has been described that applies a start-up voltage and current to a self-bias circuit to initialize its operation in its desired stable state. Once the self-bias circuit converges to its desired state of operation a start-up voltage reference/voltage clamping circuit shuts off current flow to the self-bias circuit and the start-up circuit enters a low power mode of operation to reduce its overall current and power draw. This allows for embodiments of the present invention to be utilized in portable and/or low power devices where low power consumption is of increased importance. In one embodiment of the present invention, a band-gap voltage reference circuit is initiated utilizing a start-up circuit.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A start-up circuit, comprising:

a current mirror;

a start-up voltage reference coupled to a first output of the current mirror and to ground, the startup voltage reference comprising a plurality of coupled BJT transistors, a plurality of PN junction diodes, a plurality of Schottky diodes, a plurality of diodes, a plurality of diode connected metal oxide semiconductor (MOS) transistors, a plurality of diode connected field effect transistors (FET), a plurality of resistors, or a resistor voltage divider; and an output transistor coupled between a second output of the current mirror and an output of the start-up circuit, wherein an input of the output transistor is coupled to the first output of the current mirror and the start-up voltage reference and where the output transistor is controlled by the voltage difference between a voltage output of the start-up voltage reference and a voltage of the output of the start-up circuit;

wherein the start-up circuit is adapted to turn off when the voltage of the output of the start-up circuit is greater than the start-up voltage reference.

2. The start-up circuit of claim 1, wherein the second output of the current mirror is adapted to control the current flow of the outputs of the current mirror.

3. The start-up circuit of claim 1, wherein the current mirror further comprises:

a first and second P-FET transistor, wherein a drain of the first P-FET transistor is coupled to the first output of the current mirror, a drain of the second P-FET transistor is coupled to the second output of the current mirror and to a gate of the first and second P-FET transistors.

4. A start-up circuit, comprising:

a current mirror;

a start-up voltage reference coupled to a first output of the current mirror; and an output transistor coupled between a second output of the current mirror and an output of the start-up circuit, wherein an input of the output transistor is coupled to the first output of the current mirror and the start-up voltage reference and where the output transistor is controlled by the voltage difference between a voltage output of the start-up voltage reference and a voltage of the output of the start-up circuit, wherein the current mirror further comprises a first and a second P-FET transistor, wherein a drain of the first P-FET transistor is coupled to the first output of the current mirror, a drain of the second P-FET transistor is coupled to the second output of the current mirror and to a gate of the first and second P-FET transistors, and wherein the first and second P-FET transistors are selected to have differing threshold voltages (Vtp).

5. The start-up circuit of claim 1, wherein the start-up voltage reference further comprises one or more diode coupled BJT transistors, one or more PN junction diodes, one or more Schottky diodes, one or more zener diodes, one or more diode connected metal oxide semiconductor (CMOS) transistors, one or more diode connected field effect transistors (FET), one or more resistors, and a resistor voltage divider.

6. The start-up circuit of claim 1, wherein the start-up voltage reference is selectively adjustable.

7. The start-up circuit of claim 1, wherein the output transistor is a N-FET transistor.

8. A self-bias circuit, comprising:

a feedback-controlled circuit having two or more stable states of operation, wherein the feedback controlled circuit contains a central circuit where current can be injected to bootstrap the feedback-controlled circuit into a desired state of operation; and a start-up circuit having an output, wherein the output is coupled to the central circuit, the start-up circuit comprising, a current mirror, a start-up voltage reference coupled to a first output of the current mirror and to a lower power rail;

an output transistor coupled between a second output of the current mirror and the output of the start-up circuit, wherein an input of the output transistor is coupled to the first output of the current mirror and the start-up voltage reference and where the output transistor is controlled by the voltage difference between a voltage of the start-up voltage reference and a voltage of the central circuit; and a capacitor coupled between the second output and a low power rail.

9. The self-bias circuit of claim 8, wherein the second output of the current mirror is adapted to control the current flow of the outputs of the current mirror.

10. The self-bias circuit of claim 8, wherein the current mirror further comprises:

a first and second P-FET transistor, wherein a drain of the first P-FET transistor is coupled to the first output of the current mirror, a drain of the second P-FET transistor is coupled to the second output of the current mirror and to a gate of the first and second P-FET transistors.

11. A self-bias circuit, comprising:

a feedback-controlled circuit having two or more stable states of operation, wherein the feedback controlled circuit contains a central circuit where current can be injected to bootstrap the feedback-controlled circuit into a desired state of operation; and a start-up circuit having an output, wherein the output is coupled to the central circuit, the start-up circuit comprising, a current mirror, a start-up voltage reference coupled to a first output of the current mirror, and an output transistor coupled between a second output of the current mirror and the output of the start-up circuit, wherein an input of the output transistor is coupled to the first output of the current mirror and the start-up voltage reference and where the output transistor is controlled by the voltage difference between a voltage of the start-up voltage reference and a voltage of the central circuit, wherein the current mirror further comprises:

a first and second P-FET transistor, wherein a drain of the first P-FET transistor is coupled to the first output of the current mirror, a drain of the second P-FET transistor is coupled to the second output of the current mirror and to a gate of the first and second P-FET transistors, and wherein the first and second P-FET transistors are selected to have differing threshold voltages (Vtp).

12. The self-bias circuit of claim 8, wherein the start-up voltage reference further comprises one or more diode coupled BJT transistors, one or more PN junction diodes, one or more Schottky diodes, one or more zener diodes, one or more diode connected metal oxide semiconductor (MOS) transistors, one or more diode connected field effect transistors (FET), one or more resistors, and a resistor voltage divider.

13. The self-bias circuit of claim 8, wherein the start-up voltage reference is selectively adjustable.

14. The self-bias circuit of claim 8, wherein the output transistor is a N-FET transistor.

15. The self-bias circuit of claim 8, wherein the self-bias circuit is one of band-gap voltage reference circuit, a current reference, a A/D converter, a D/A converter, and a feedback circuit.

16. A start-up circuit, comprising:

a means for providing a mirrored current having a first and second outputs, wherein the current flowing from the second output controls the current flowing from the first output;

a means for providing a start-up voltage reference coupled to a first output of the current mirror means;

means for capacitively coupling gates of transistors of the current mirror to a low power rail during power up, wherein the means for capacitively coupling gates of transistors of the current mirror to a low power rail is selected; and means for selectively coupling the second output of the current mirror means to an output of the start-up circuit, wherein the means for selectively coupling the second output of the current mirror means has a control means coupled to the first output of the current mirror means and is controlled by difference between a voltage of the start-up voltage reference means and a voltage of the output.

17. The start-up circuit of claim 16, wherein the means for providing a mirrored current has differing current sources such that the first output has a means for shutting off current flow before the second output.

* * * * *